United States Patent [19]

Mardollo

[11] Patent Number: 4,997,150

[45] Date of Patent: Mar. 5, 1991

[54] ADJUSTABLE OLEOPNEUMATIC SUPPORT

[75] Inventor: Scipione Mardollo, Padua, Italy

[73] Assignee: Lifter S.r.L., Italy

[21] Appl. No.: 432,751

[22] PCT Filed: Apr. 17, 1987

[86] PCT No.: PCT/IT87/00036

§ 371 Date: Nov. 17, 1989

§ 102(e) Date: Nov. 17, 1989

[87] PCT Pub. No.: WO88/07828

PCT Pub. Date: Oct. 20, 1988

[51] Int. Cl.[5] ..... F16M 11/00

[52] U.S. Cl. ..... 248/161; 248/631; 267/64.12

[58] Field of Search ..... 248/161, 162.1, 406.2, 248/157, 562, 566, 631; 188/300; 267/64.12, 131, 132

[56] References Cited

U.S. PATENT DOCUMENTS

| | | | |
|---|---|---|---|
| 3,426,651 | 2/1969 | Arendarski | 267/64.12 X |
| 3,865,341 | 2/1975 | Fortnam et al. | 248/404 |
| 4,139,175 | 2/1979 | Bauer | 248/404 |
| 4,183,689 | 1/1980 | Wirges et al. | 248/161 X |
| 4,318,536 | 3/1982 | Bauer | 267/64.12 |
| 4,580,749 | 4/1986 | Howard | 248/161 |
| 4,720,068 | 1/1988 | Tornero | 248/161 |
| 4,756,496 | 7/1988 | Hosan et al. | 248/161 |
| 4,817,898 | 4/1989 | Locher | 267/64.12 X |
| 4,844,392 | 7/1989 | Bauer et al. | 248/162.1 |
| 4,940,202 | 7/1990 | Hosan et al. | 248/162.1 |

*Primary Examiner*—Ramon O. Ramirez

*Attorney, Agent, or Firm*—Curtis, Morris & Safford

[57] ABSTRACT

An adjustable oleopneumatic support, particularly for the height adjustment of the seats of office chairs with central columns, is disclosed. The oleopneumatic element includes a hollow cylindrical body with a packing member realizing an upper and a lower cavity, the respective lower end being rigidly linked to the base of the chair, and a coaxial hollow stem, the head of which is rigidly linked to the seat of the same chair, the hollow coaxial stem being rigidly connected to a piston which defines inside the upper cavity two chambers, an upper and a lower chamber, respectively, both containing fluid; the hollow coaxial stem is provided inside with valvular coaxial actuation means controlling a passage for a hydraulic fluid, the respective outlets being placed above and below the piston, respectively; the lower cavity being able to contain compressed gas.

8 Claims, 2 Drawing Sheets

ADJUSTABLE OLEOPNEUMATIC SUPPORT

The present invention concerns an adjustable oleopneumatic support, particularly fit for chairs with central column.

In chairs with a central column an adjustable, gas shock-absorber supports are commonly used. Such support are generally placed in a vertical position inside a guiding telescope cladding, with the ends respectively, connected to the base and the seat of the chair, and support the load applied in a spring fashion.

Such well known gas shock-absorbers are mainly constituted of a piston which, upon application of the load, compresses the gas stored in side until its pressure balances the action of the load; in such condition of equilibrium, the same pressure acting on the piston, is reached by the gas, thereby supporting the chair and the load applied on it.

The height adjustment of the seat can be effected by opening, with predisposed valvular means, an inner passage which connects the chamber in which the piston slides to an adjacent compressed gas chamber.

In the absence of a load, the opening of the passage causes the gas to exit from said chamber and, upon expanding the gas lifts the piston; vice versa, by application of a sufficiently heavy load, contemporaneous reverse opening condition occurs which causes the lowering of the piston and the passage of a further quantity of gas into said chamber with the raising of the pressure in its interior. Such were known gas shock-absorbers, though revealing themselves valid from an exclusively pratical point of view, are not free from inconveniences, principal among which is the fact that the gas compressed in the shock absorbers reaches a very high pressure which notoriously results in serious leakage and escapage of gas and ultimate discharge of the shock absorber.

In relation to both the stress generated by the high pressure, aiming to keep within acceptable limits the thickness of the components, of the shock-absorber and to the avoidence of too high springing run, small-diameter tubular elements are generally used however, due to high load points, such small-diameter tubular elements do not possess the necessary stability and must be normally assembled in combination with complementary devices, such as guiding telescopic claddings of bigger dimensions.

An object of the present invention is to eliminate the drawbacks above mentioned in well known types of gas shock-absorbers, by providing an adjustable support in which the height adjustment occurs by fluid shifting from one chamber to the other, without compression, so as to keep low in every situation the value of the interior pressure and which, uses as operating fluid an uncompressable liquid, thereby simplifying appreciably all the problems connected with gas proofing at high pressure.

Another object of the invention is to achieve an adjustable oleopneumatic element which, for its own peculiar structural characteristics, can support with security and without buckling the full stress springing from the loads applied on the chair, so as to be used singularly, without employing complementary devices.

Still another object of the invention is to provide an oleopneumatic support with valvular means of adjustment which, besides being extremely functional and reliable, present an encumbrance extremely reduced, so as to be easily lodged inside the same supporting element, without requiring particular constructive complications.

Yet another object of the invention is to provide an adjustable oleopneumatic support which is easily constructed from elements and materials commonly available in commerce, which is rapidly assembled and which is economically competitive.

These and other objects, features and advantages of the invention are achieved by an adjustable oleopneumatic support, particularly for chairs with a central column, including a hollow cylindrical body, of with a central column, including a hollow cylindrical body, of which lower base is rigidly linkage to the base of the chair, and a coaxial stem, of which head is rigidly linkage to the seat of the same chair, in which the stem is fluently, and sealingly coupled with the upper base of said cylindrical body and with a transversal septum which separates the interior of said cylindrical body in an upper cavity, developing itself in correspondence to said upper base, and in a lower cavity developing itself in the opposite side. The stem is rigidly associated to a piston which defines inside the upper cavity two chambers, both containing fluid; the shifting of said piston inside said upper cavity causes, through oil passage way valvular means, the transitory passage of said fluid from one chamber to the other allowing, for the contrast and action of a compressed gas present inside of said lower cavity, the height adjustment of the seat of the chair characterized in that said oil passageway with valvular means includes a mobile shutter block slidable in said coaxial stem presenting, in its own lateral surface, in one shift position a first reduced annular area connecting said two opposed outlet oil passage way means to link the opposed chambers, and in the opposed shifted position interdiction of said oil passage way.

Further characteristics and advantages of the invention will been seen from the following description of a preferred embodiment illustrated by way of example in the enclosed drawings, in which.

Figure 1:
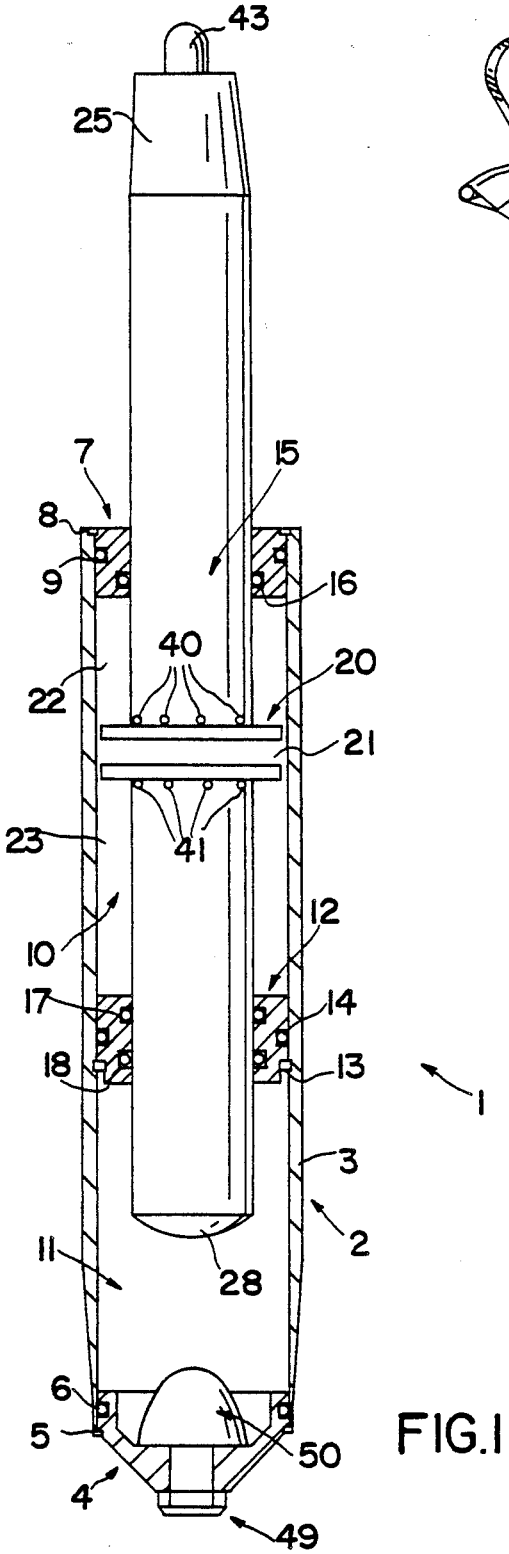
FIG. 1 is a side view of the oleopneumatic element, in which the cylindrical body is represented in a longitudinal section.
Figure 4:
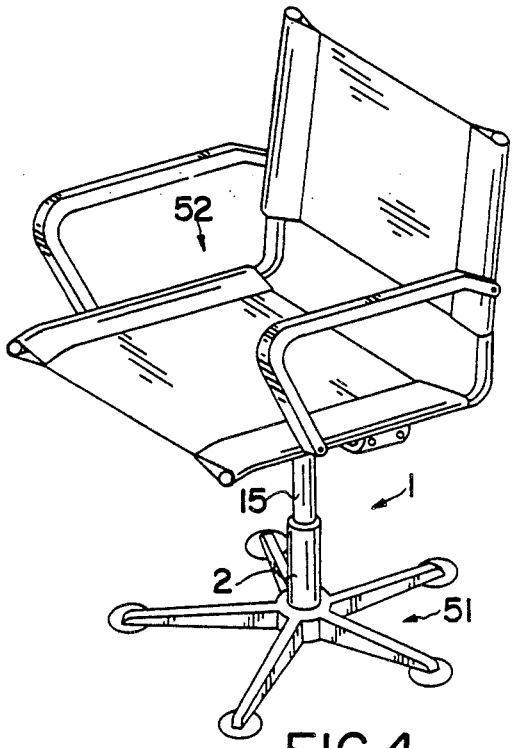
FIG. 4 is a perspective view of a chair with central column.

With reference to the drawings, an adjustable oleopneumatic support, inclusively indicated with reference number 1, includes a hollow cylindrical body 2, opportunely constituted for a first tubular element 3 closed, leak proof, in its own lower base, externally tapered, by a cap 4.

The cap 4 is fixed, with a first elastic ring 5 and is then equipped with a first sealing gasket ring 6; in the same way, in other realizable forms; the cap 4 can directly be fixed to the first tubular element 3 by a circumferential welding cord.

To the base opposite to the cap 4, on the first tubular element 3 is connected a holed stem guiding plate 7, fixed hydraulic seal for example by an elasting ring 8, with the interposition of a second sealing gasket ring 9.

According to the invention, the inside of the cylindrical body 2 is divided into two cavities, respectively upper 10 and lower 11, by a holed transversal chamber partition septum 12, which is advantageously bound or fixed, leak proof, to the first tubular element 3 by a third elestic ring 13 and with the interposition of a third sealing gasket ring 14.

Coaxially to the cylindrical body 2, the oleopneumatic element 1 includes a stem 15, axially sliding through both the stem guiding plate 7 and the chamber partitium septum 12, according to couplings rendered leak proof by the presence of seal means, respectively advantageously constituted by sliding gasket oilseal rings 16 in said stem guiding plate 7 and sliding gasket oilseal ring 17–18 in said chamber partition septum.

Figure 2:
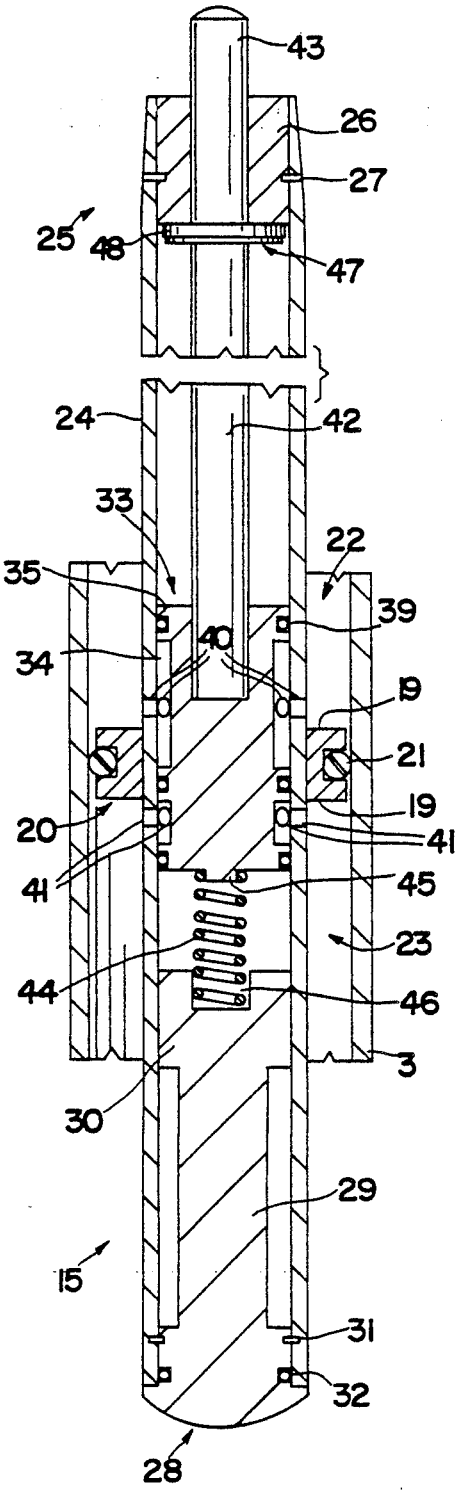
FIG. 2 is a longitudinal section that evidences the valvular means in a closed position.
Figure 3:
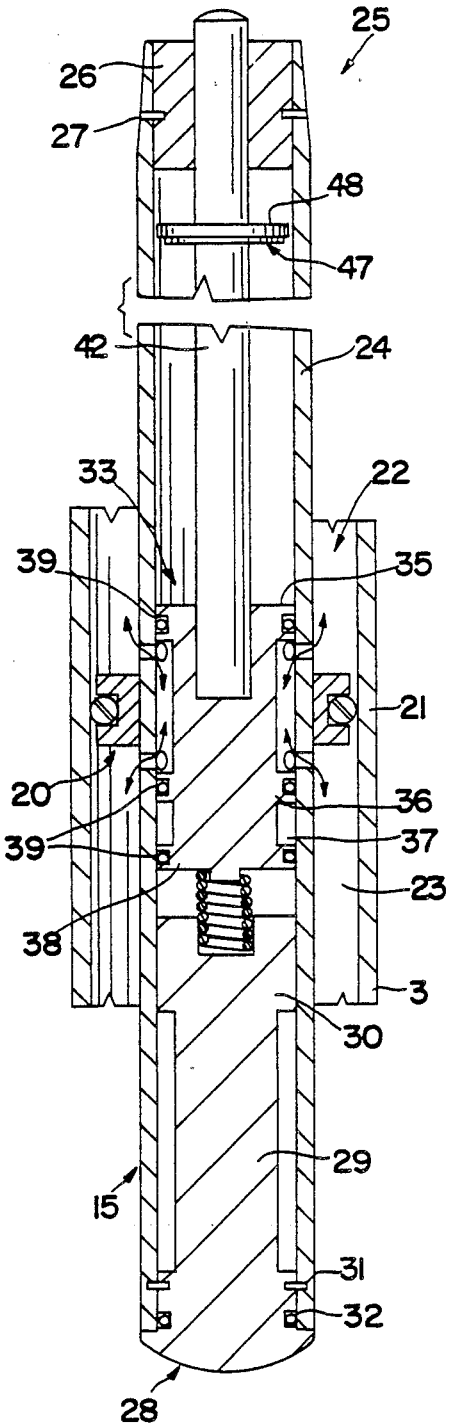
FIG. 3 is a longitudinal section that evidences the valvular means in an opened position.

To the stem 15 is rigidly fixed, as for example shown in FIGS. 2 and 3 with the use of stopping ring means 19 of sliding gasket oilseal ring means 21 (e.g., O-ring), piston 20 slidable in the upper cavity or chamber partition 10 of the cylinder 3.

The piston divides the upper cavity 10 into two chambers, respectively upward and downward chamber 22 and 23, of which both contain fluid, for example hydraulic oil, for which the shifting of the piston 20, and consequently of the stem 15, is possible only with the opening of appropriate valvular means provided by holes 40, 41 which allow the fluid to move from one chamber to the other and vice versa.

Advantageously, as evidenced in the drawings 2 and 3, the valvular means are housed inside the hollow stem 15 advantageouusly realized in tubular form 24 closed in correspondence of its own head 25, externally tapered by a holed cylindrical shutting element 26, fixed by a first elastic stopping ring 27 and, on the opposite side, by a cap 28 externally bulged.

The cap 28, which develops itself towards the inside of the stem 15, with its own stem 29 having a cylindrical end 30, is advantageously fixed to the tubular stem 24 by a second elastic stopping ring 31 and is equipped, in the bulged space, of a first sealing ring 32.

According to the invention, the valvular means inside the stem 15, include a shutting block 33, substantially cylindrical, which presents, in its own lateral surface, a reduced upper area 34, placed between an upper edge 35 an a middle edge 36, and a reduced lower area 37, placed between the middle edge 36 and a lower edge 38.

All three edges 35, 36 and 38 are equipped with suitable sealing slidable gasket rings 39 sealing said reduced upper area and said reduced lower area 34,37 in correspondence of respective holes 40,41 allowing to pass the oil from the upwards chamber to the downwards chamber and vice versa only if the reduced upper area is placed between holes 40, (stem-rod 42-3 pushed down).

More particularly, while the upper edge 35 moves, remaining however always above the first set of holes 40 and the lower edge 38 always below the second set of holes 41, the middle edge 36, in its movement, can overpass the second set of holes 41 shifting above and under it.

On one side of the block 33 is connected the stem-rod 42, coaxial to the stem 15, which protrudes with its own end 43 from the head 25; on the opposite side of the block 33 act instead elastic means, advantageously constituted by a spiral spring 44 abutting in correspondent axial bulb-seat protrusion 45.

The spiral sring 44 is compressed between an axial protrusion 45 of the block 33 and a seat 46 opportunely obtained on the cylindrical end 30 of the cap 28.

The spring 44 presses on the block 33 causing the upward movement until the stopping plate 47, elastically fixed into a suitable seat present in the upper portion of the internal stem-rod 42 and efficiently constituting a checking element, goes to engage itself, with the interposition of a rubber ring 48, against the shutting cylindrical element 26; in this position, the middle edge 36 finds itself between the two sets of holes 40 and 41, while the upper edge 35 and the lower edge 38 find themselves respectively above the first set of holes 40 and below the second set of holes 41.

Moreover it must be specified that in the cap 4 is present a threaded hole in which advantageously can be mounted a valve, or a shutting sealproof screw 49, which allows the filing of the lower cavity 11 with compressed gas, as for example compressed air; further in correspondence to the inside face of the cap 4 there is an end-stroke stopper 50, for example in rubber, which, at the total lowering of the stem 15, engages itself with the cap 28.

From the foregoing description the functioning of the adjustable oleopneumatic support, according to the invention, appears evident and can be summarized as follows.

The lower base of cylindrical body 2 and the head 25 of the stem 15 are respectively connected, exploiting opportunely the taper, to a base 51 and to a seat 52 of a chair with central column, as shown simply as an example in drawing 4.

In absence of action on the upper end 43, the spring 44 maintains the stopping plate 47 engaged against the cylindrical shutting element 26, so that the shutter block 33 finds itself in a position correspondent to the positioning of its middle edge 36, between the two sets of holes 40 and 41; with the valvular means in this position no traversing of oil can obviously occur between the two chambers 22 and 23 and the stem 15 is blocked and able to support eventual loads which are applied to and act on the seat 52 of the chair (FIG. 2).

To modify the length of the adjustable oleopneumatic support and thereby accomplish the height adjustment of the seat 52 the upper end 43 of the inner stem-bar 42, is pressed down causing compression of the spring 44 and moving the shutter block 33 into the position shown in FIG. 3; in such position the recessed upper area 34 puts into comunication the two sets of holes 40 and 41, determining a circumferential passage that allows the oil to flow from one to the other of the two upwards and downwards chambers 22 and 23, as shown by the arrows in the drawing.

If one desires to raise the seat 52, it is sufficient to keep the end 43 pressed without applying loads to the chair until the stem lifts itself to the position desired, pushed by the action exerted on the convex bottom of the cap 28 by the pressure of the gas inside the lower cavity 11; if, vice versa, one wishes to lower the seat 42, he must simultaneously apply to the chair a light downwards push sufficient to win the modest gas pressure to make the stem 15 go down, inside the lower cavity 11, as much as desired.

Having accomplished the adjustment, the end 43 is released and the shutter block 33 returns into the shutting position, blocking the stem 15 at the chosen height.

It is obvious that the presence of the upper edge 35 and the lower edge 38 prevent in every situation the flow of the oil outside; particularly, the lower edge 38 keeps the area below the shutter block clear so that the lowering of the shutter block 33 will not be hindered by the presence of oil, the movement of shutter block 33 always will be smooth and the force to be applied to the end 43 always will be of modest intensity.

It has been verified in practice that the application of leads, even considerable, on the chair, is totally transferred from the piston 20 to the oil, which acts as sole supporting element.

It is moreover evident that the gas which is inside the lower cavity 11, does not suffer in any way from the applied load because it does not bear any supporting function but it is only used to supply the necessary push to raise the seat during the adjustment; therefore the pressure of the gas will be of a modest value, affording the advantages of leak proofness, safety and reliability of the oleopneumatic support.

Moreover, the lower pressures involved allow for the use of a cylindrical body 2 of a bigger diameter which associated with the particular stability of the stem 15, due to the movement through three guiding elements (holed plate 7, septum 12 and piston 20), allow the realization of supporting elements 2 that just by themselves have the necessary a stability and lift force to render superfluous the use of auxiliary supporting elements of stabilizing shells.

The invention so conceived is susceptible of many modifications, all within the ambit of the inventive conception; so for example, modifications different from those illustrated herein might be made to the valvular means and to the leak proof connections between the various elements. Moreover, various elements illustrated herein might be replaced by other technically equivalent elements. Nevertheless, such modifications an replacements are within the scope and spirit of the present invention.

In practice, the materials employed, provided they are compatible with the contingent use and dimensions, might be according to the demand and the technical state.

I claim:

1. An adjustable oleopneumatic support comprising:

(a) a hollow, cylindrical body having an interior;

(b) a hollow, cylindrical stem coaxially and sealingly slidable inside said cylindrical body;

(c) an annular partition septum mounted transverse to said hollow stem and at an intermediate position of said cylindrical body so that said annular position septum divides the interior of said cylindrical body into upper and lower cavities;

(d) a piston rigidly associated to said cylindrical stem, said piston defining inside said upper cavity an upward chamber and a downward chamber; and (e) valvular actuation means coaxially inserted in said cylindrical stem, said valvular actuation means including upward and downward fluid passageway means and a shutter block slidably inserted inside said cylindrical stem and movable between first and second positions, said shutter block including a lateral surface having a first reduced annular area so that when said shutter block is moved to said first position, said first reduced annular area connects said upward and downward fluid passageway means and when said shutter block is moved to said second position, said upward and downward fluid passageway means are disconnected.

2. An adjustable oleopneumatic support according to claim 1, wherein said shutter block further includes a second reduced annular area adjacent to said first reduced annular area, said first and second reduced annular area being separated from one another by a middle circumferential edge and delimited externally by an upper circumferential edge and a lower circumferential edge, said middle, upper and lower edges coupling themselves fluently, and further including a hydraulic seal sealingly abutting an interior wall of said cylindrical stem.

3. An adjustable oleopneumatic support according to claim 2, wherein said upper and middle circumferential edges are in spaced relationship to one another and comprise said fluid passageway means.

4. An adjustable oleopneumatic support according to claim 1, wherein said cylindrical stem further includes a head.

5. An adjustable oleopneumatic support according to claim 4, further including a coaxial stem-bar connected to said shutter block and substantially upwardly protruding from the head of said cylindrical stem, said coaxial stem-bar allowing downward movement of the shutter block which in turn places said first reduced annular area into said first position so as to allow interconnection of said upward and downward chambers and consequent free fluid passage therebetween.

6. An adjustable oleopneumatic support according to claim 1, further including elastic means located under said shutter block at said lower circumferential edge.

7. An adjustable oleopneumatic support according to claim 1, wherein said cylindrical body further includes a base and an occludable opening for filling said lower cavity with gas.

8. An adjustable oleopneumatic support according to claim 7, wherein said lower cavity includes elastic abutment means to stop downward shifting of said cylindrical stem.

* * * * *